US005212763A

United States Patent [19]

Arold et al.

[11] Patent Number: 5,212,763

[45] Date of Patent: May 18, 1993

[54] ELECTRIC FLUID HEATER WITH INFRARED HOT SPOT SENSOR

[75] Inventors: Jonathan B. Arold, Exeter; E. Forrest Decatur, E. Kingston; Joan L. Mishou, Portsmouth, all of N.H.

[73] Assignee: GTE Products Corporation, Danvers, Mass.

[21] Appl. No.: 943,633

[22] Filed: Sep. 11, 1992

[51] Int. Cl.[5] ..... H05B 1/02; F24H 1/10

[52] U.S. Cl. ..... 392/488; 219/502; 392/379; 392/473; 392/491

[58] Field of Search ..... 392/485–495, 392/379, 473–477, 418; 219/502, 552, 553

[56] References Cited

U.S. PATENT DOCUMENTS 3,423,572 1/1969 Pansing ..... 392/418 X
3,551,643 12/1970 Pricenski ..... 219/553 X
3,654,431 4/1972 Brouks et al. ..... 392/488 X
3,783,236 1/1974 Edin ..... 219/553 X

FOREIGN PATENT DOCUMENTS 2364975 7/1975 Fed. Rep. of Germany ..... 392/485

*Primary Examiner*—Anthony Bartis
*Attorney, Agent, or Firm*—James Theodosopoulos

[57] ABSTRACT

A forced gas electric heater has a serpentine heating element disposed within a cylindrical glass tube. Infrared radiation emanating from the heating element enters the glass tube whereby part of the infrared radiation is directed within the wall of the glass tube to the edge of the glass tube. An infrared sensor is in line of sight with the edge of the glass tube. The infrared sensor senses the hot spot temperature of the heating element and, together with a controller, limits the maximum hot spot temperature of the heating element.

2 Claims, 1 Drawing Sheet

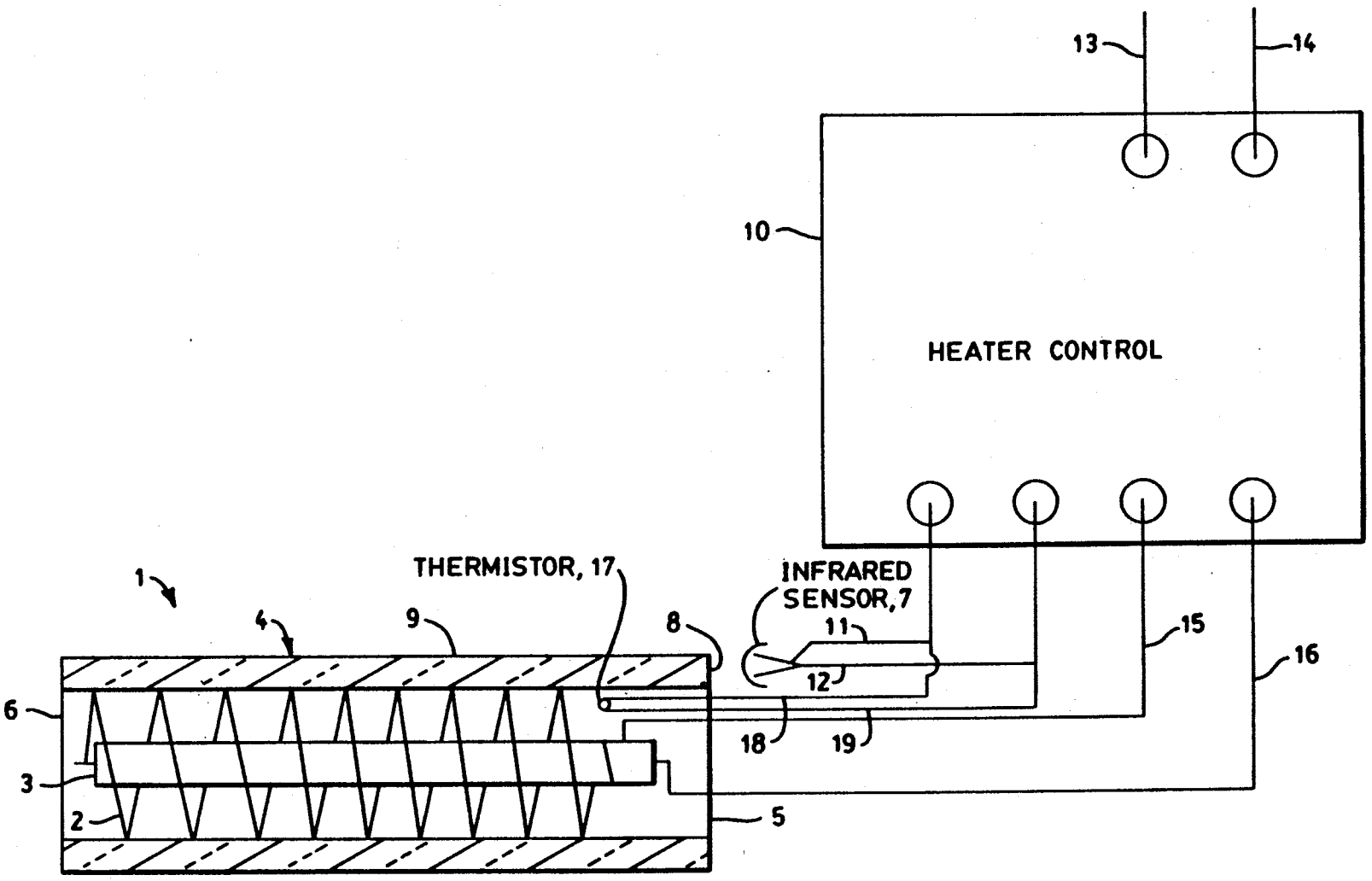
HEATER CONTROL
INFRARED SENSOR, 7
THERMISTOR, 17
1
2
3
4
5
6
8
9
10
11
12
13
14
15
16
18
19

ELECTRIC FLUID HEATER WITH INFRARED HOT SPOT SENSOR

This invention concerns forced air or gas heaters. Examples thereof are shown in U.S. Pat. Nos. 3,551,643, 3,654,431, 3,783,236 and 5,111,527, the disclosures of which are incorporated herein by reference. The heaters comprise serpentine heating elements through which the air or gas to be heated flows.

A purpose of this invention is to eliminate premature burnout of the heating element. This is accomplished by sensing the hot spot temperature of the heating element and limiting the maximum hot spot temperature to a predetermined value.

A forced gas electric heater in accordance with this invention comprises a serpentine heating element disposed within a closely fitting cylindrical glass tube, the glass tube having an inlet end where gas to be heated enters and an outlet end where the heated gas exits. The glass tube is a light pipe whereby part of the infrared radiation emanating from the heating element when it is at an infrared radiating temperature is directed within the wall of the glass tube to the edge of the glass tube. There is an infrared sensor disposed in line of sight with the edge of the glass tube, the infrared sensor being responsive to the hot spot temperature of the heating element along the entire length thereof. There is a controller electrically connected to the infrared sensor, the controller acting to control current flow through the heating element. The combination of the controller and infrared sensor act to limit the maximum hot spot temperature of the heating element to a predetermined temperature.

The drawing is a diagrammatic representation of a forced gas electric heater in accordance with this invention.

As shown in the drawing, one example of a forced gas electric heater 1 in accordance with this invention comprises a serpentine heating element 2 having a ceramic core tube 3 extending through the center thereof. Disposed around serpentine heating element 2 is a closely fitting cylindrical glass tube 4. Gas to be heated is forced into inlet end 5 of glass tube 4 and exits at exit end 6. An infrared sensor 7 is disposed in line of sight with edge 8 of glass tube 4. Infrared radiation emanating from heating element 2 enters wall 9 of glass tube 4 and is directed within wall 9 to edge 8. Infrared sensor 7 is electrically connected to controller 10 by wires 11 and 12. Electrical power for controller 10 and for heating element 2 enters controller 10 by means of wires 13 and 14. Wires 15 and 16 supply power to heating element 2. Disposed within the inlet end of glass tube 4 is a thermistor 17 which is electrically in parallel with infrared sensor 7 and which is connected to controller 10 by means of wires 18 and 19. The purpose of thermistor 17 is to limit the ambient temperature at infrared sensor 7 to protect it from overheating during prolonged periods when there is no air flow through heating element 2.

The operating temperature for a heater in accordance with this invention is about 600° or 700° C. to about 1200° C. Accordingly, glass tube 4 should be made of a sufficiently high melting glass, for example, borosilicate at lower temperatures, quartz at higher temperatures.

We claim:

1. A forced gas electric heater comprising a serpentine heating element disposed within a closely fitting cylindrical glass tube, the glass tube having an inlet end where gas to be heated enters and an outlet end where the heated gas exits, the glass tube being a light pipe whereby part of the infrared radiation emanating from the heating element, when it is at an infrared radiating temperature, is directed within the wall of the glass tube to the edge of the glass tube, an infrared sensor disposed in light of sight with said edge of the glass tube, the infrared sensor being responsive to the hot spot temperature of the heating element along the entire length thereof, a controller electrically connected to the infrared sensor, the controller and infrared sensor operative to control current flow through the heating element and to thereby limit the maximum hot spot temperature of the heating element to a predetermined temperature.

2. The forced gas electric heater of claim 1 comprising, in addition, a thermistor disposed within the inlet end of the glass tube, the thermistor being electrically in parallel with the infrared detector and being electrically connected to the controller.

* * * * *